United States Patent [19]

Denton

[11] Patent Number: 5,035,321

[45] Date of Patent: Jul. 30, 1991

[54] CLEANING SUPPLIES CADDY

[76] Inventor: Thomas A. Denton, 797 Phelan Rd., #9, Pinon Hills, Calif. 92372

[21] Appl. No.: 510,974

[22] Filed: Apr. 18, 1990

Related U.S. Application Data

[63] Continuation-in-part of Ser. No. 384,452, Jul. 21, 1989.

[51] Int. Cl.[5] ..... B65D 81/36; B65D 85/671

[52] U.S. Cl. ..... 206/225; 206/229; 206/233; 220/318

[58] Field of Search ..... 206/223–226, 206/229, 233, 389, 390, 409, 576; 220/315, 318, 325, 327, 328

[56] References Cited

U.S. PATENT DOCUMENTS

| | | | |
|---|---|---|---|
| 1,255,772 | 2/1918 | Miller | 206/226 |
| 2,409,465 | 10/1946 | Armbruster et al. | 206/226 |
| 2,410,928 | 11/1946 | Christner et al. | 206/229 |
| 2,772,809 | 12/1956 | Ross | 206/318 |
| 2,965,109 | 12/1960 | Borah | 206/229 |
| 3,887,103 | 6/1975 | Spooner | 206/229 |
| 4,360,123 | 11/1982 | Blease | 220/318 |
| 4,516,676 | 5/1985 | Cournoyer | 206/229 |
| 4,588,083 | 5/1986 | Hunt | 220/327 |
| 4,887,713 | 12/1989 | Tupper | 206/229 |
| 4,936,452 | 6/1990 | Pauley | 206/390 |

*Primary Examiner*—Jimmy G. Foster
*Attorney, Agent, or Firm*—Stetina and Brunda

[57] ABSTRACT

A cleaning supplies caddy for storing and transporting cleaning supplies is disclosed. The compact cleaning supplies caddy can hold four bottles of cleaning fluids or the like, a full roll of paper towels, and has enough room remaining to contain a variety of sponges and brushes. The lid or upper housing of the cleaning supplies caddy can be used as a water bucket. A convenient dispenser for the paper towels is also provided. The cleaning supplies caddy comprises a removable upper housing which latches to a lower housing by means of a twist-lock. The twist-lock provides a convenient means of latching the upper housing to the lower housing while maintaining a watertight seal at the latch such that the upper housing may be inverted and used as a water bucket. The twist-lock has a handle which may be used for both actuating the twist-lock and for carrying the cleaning supplies caddy.

9 Claims, 2 Drawing Sheets

CLEANING SUPPLIES CADDY

RELATED INVENTIONS

This subject application is a continuation-in-part of copending application Ser. No. 07/384,452 filed on July 21, 1989, entitled PORTABLE CASE FOR CLEANING FLUIDS AND DISPOSABLE TOWELS.

FIELD OF THE INVENTION

The present invention relates generally to containers and more particularly to a cleaning supplies caddy for storing and transporting cleaning supplies. The lid or upper housing of the cleaning supplies caddy can be used as a water bucket. A convenient paper towel dispenser is also provided.

BACKGROUND OF THE INVENTION

As is well known, cleaning supplies such as detergents, upholstery cleaners, glass cleaners, paper towels, and the like are commonly used in the cleaning of cars, trucks, boats, and recreational vehicles.

It is necessary to carry the cleaning supplies to the vehicle and is often desirable to transport the cleaning supplies within the vehicle.

A wash bucket is often required when cleaning a vehicle. The wash bucket is typically used initially to contain water and detergent for washing the vehicle and may subsequently be used to contain water for rinsing the vehicle.

Paper towels are commonly used to clean glass and upholstered surfaces, and also to apply protective finishes to upholstered surfaces and the like. Paper towels are also used for cleaning grease or oil from the engine and other areas of the vehicle. Paper towels find many applications in the cleaning of vehicles.

Paper towels are typically dispensed by hand, thereby resulting in a considerable inconvenience to the user. This inconvenience results from the fact that the user must locate the paper towel roll for each use, pick up and handle the roll in order to dispense the desired quantity of paper towels, and place the roll in a location where the user will be likely to find it at a later time.

It is often difficult to locate the paper towel roll when cleaning a vehicle because the user commonly moves from one area to another as cleaning progresses. The user commonly places the paper towel roll in a different location after each use. This makes it necessary for the user to continually search for the paper towel roll as paper towels are required.

Cleaning supplies are commonly carried in a piecemeal fashion from a common storage location, such as beneath the kitchen sink, to the vehicle to be cleaned. This typically involves several trips and is a considerable inconvenience to the user of the cleaning supplies. Also, it is often the case that the cleaning supplies are not stored within a common location, thereby necessitating that the user locate individual cleaning supplies prior to carrying the cleaning supplies to the vehicle to be cleaned. In addition, a wash bucket and paper towels must be located and carried to the vehicle. Therefore, merely obtaining the necessary supplies and equipment at the vehicle can be a time-consuming and bothersome task.

As such, it would be desirable to provide a single means for transporting and storing cleaning supplies, for dispensing paper towels, and for providing a water container or wash bucket for washing a vehicle.

Although the prior art has recognized to a limited extent the problems of transporting and storing cleaning supplies, dispensing paper towels, and providing a water container, the proposed solutions have to date been ineffective in providing a satisfactory remedy.

SUMMARY OF THE INVENTION

The present invention specifically addresses and alleviates the above mentioned deficiencies. More particularly, the present invention comprises a cleaning supplies caddy for storing and transporting cleaning supplies. The compact cleaning supplies caddy can hold four bottles of cleaning fluids or the like, a full roll of paper towels, and has enough room remaining to contain a variety of sponges and brushes. The lid or upper housing of the cleaning supplies caddy can be used as a water bucket. A convenient dispenser for paper towels is also provided.

The cleaning supplies caddy comprises a removable upper housing which latches to a lower housing by means of a twist-lock. The twist-lock provides a convenient means of latching the upper housing to the lower housing while maintaining a water-tight seal at the latch such that the upper housing may be inverted and used as a water bucket. The twist-lock has a handle which may be used for both actuating the twist-lock and for carrying the cleaning supplies caddy.

The cleaning supplies caddy therefore provides a convenient means of transporting cleaning supplies to and from a vehicle to be cleaned and also provides a convenient container for storing cleaning supplies within the vehicle. The cleaning supplies caddy eliminates the problems associated with gathering together the cleaning supplies required for cleaning a vehicle and provides a handy and convenient means of dispensing paper towels and the like. It eliminates the problem of locating paper towels each time they are required during the cleaning process. The cleaning supplies caddy also eliminates the problem of locating a wash bucket for washing and rinsing the vehicle.

These, as well as other advantages of the present invention will be more apparent from the following description and drawings. It is understood that changes in the specific structure shown and described may be made within the scope of the claims without departing from the spirit of the invention.

DETAILED DESCRIPTION OF THE PREFERRED EMBODIMENT

Figure 1:
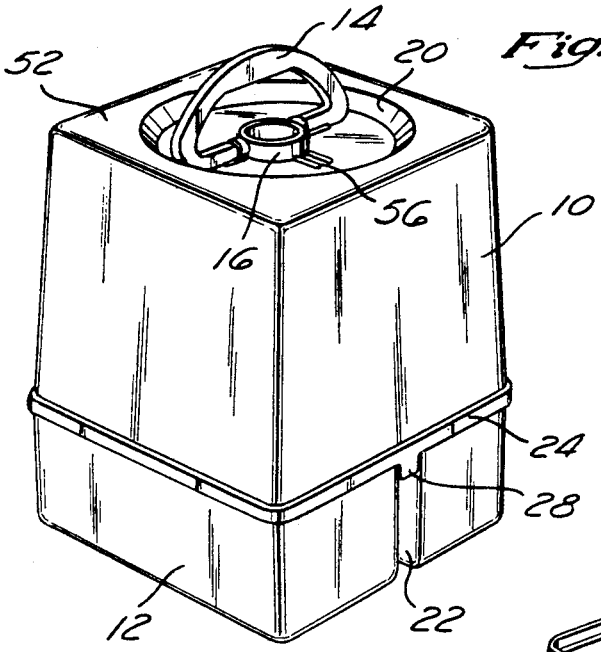
FIG. 1 is a perspective view of the cleaning supplies caddy of the present invention.
Figure 2:
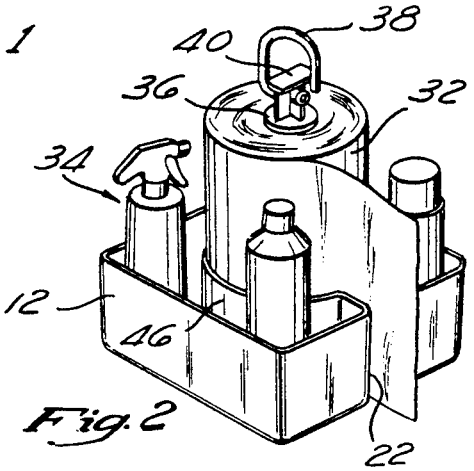
FIG. 2 is a perspective view of the lower housing of the cleaning supplies caddy of FIG. 1 having cleaning supplies disposed therein.
Figure 3:
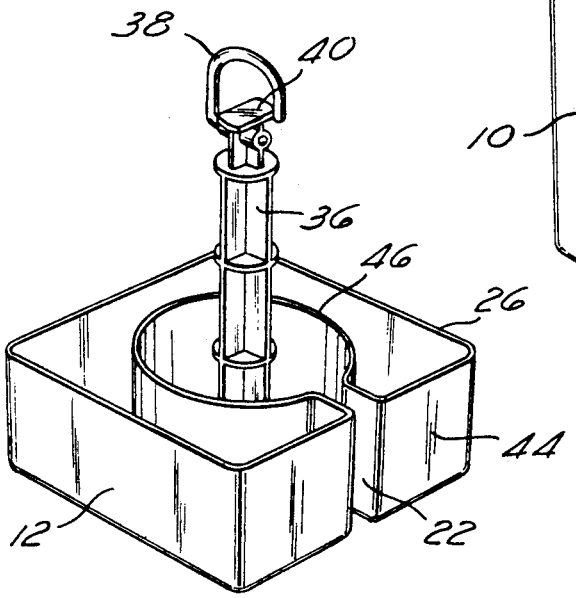
FIG. 3 is an enlarged perspective view of the lower housing of FIG. 2 having the cleaning supplies removed.

The cleaning supplies caddy of the present invention is illustrated in FIGS. 1 through 8 which depict a presently preferred embodiment of the invention.

The detailed description set forth below in connection with the appended drawings is intended as a description of the presently preferred embodiment of the invention, and is not intended to represent the only form in which the present invention may be constructed or utilized. The description sets forth the functions and sequence of steps for constructing and operating the invention in connection with the illustrated embodiments. It is to be understood, however, that the same or equivalent function and sequences may be accomplished by different embodiments that are also intended to be encompassed by the spirit and scope of the invention.

Referring now to FIGS. 1 through 5, the cleaning supplies caddy of the present invention comprises an upper housing 10 and a lower housing 12. The upper housing 10 is removably attachable to the lower housing 12. In the preferred embodiment, the cleaning supplies caddy is generally rectangular in shape, although those skilled in the art will recognize that other shapes are suitable.

A handle 14 disposed upon the upper surface 52 of the upper housing 10 provides a means for carrying the cleaning supplies caddy of the present invention and also provides a means for engaging and disengaging a twist-lock latching mechanism which secures the upper housing 10 to the lower housing 12. The handle 14 can be rotated about a horizontal axis between operably disposed and stowedly disposed positions. The handle 14 can also be rotated about a vertical axis to engage and disengage the twist-lock. Detents 54 and 56 temporarily lock the handle 14 in either the CLOSED or OPEN position. Indicia 58 designate which detents 54 or 56 function to temporarily lock the handle 14 in the OPENED and CLOSED positions.

A tab 28 formed upon the lip 24 of the upper housing 10 is received by a channel 22 formed between the first wall 44 and the second wall 46 of the lower housing 12. The tab 28 and channel 22 cooperate to provide an alignment index to insure proper orientation of the upper housing 10 upon the lower housing 12.

Cleaning supplies 34 may be disposed within the lower housing 12. A roll of paper towels 32 may be disposed upon the second shaft 36 and conveniently dispensed through the channel 22.

Second wall 46 isolates the paper towel roll 32 from the cleaning supplies 34. The second wall 46 thereby prevents the cleaning supplies 34 from interfering with the dispensing of paper towels 32. The cleaning supplies 34 could wedge between the paper towels 32 and the first wall 44 if there was no second wall 46. This would jam the paper towel roll 32 and prevent it from rotating.

A first shaft 16 transmits rotational motion of the handle 14 through the upper surface 52 to the twist-lock mechanism 82 within the upper housing 10. The handle 14 and first shaft 16 are disposed within a recess 20 formed within the upper surface 52.

Figure 4:
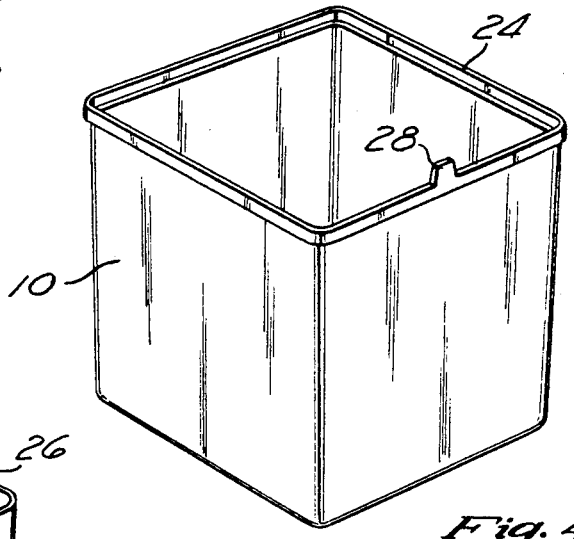
FIG. 4 is a perspective view of the upper housing of FIG. 1 disposed in an inverted position for use as a wash bucket.
Figure 5:
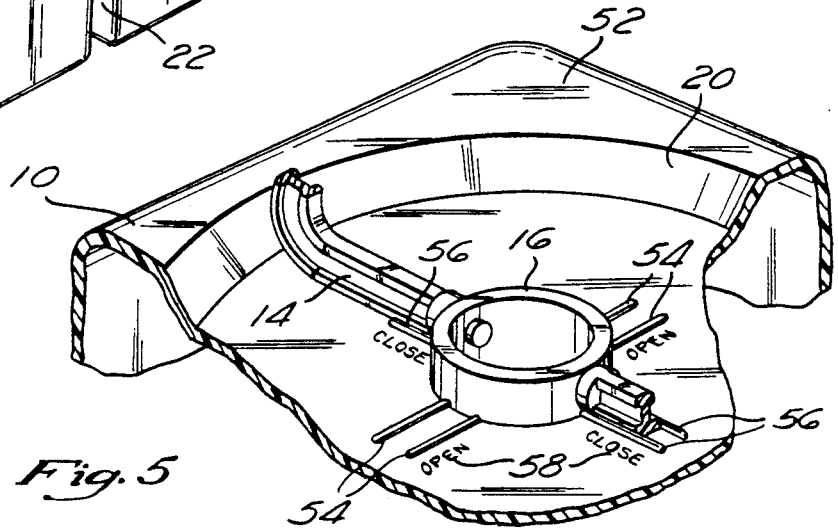
FIG. 5 is an enlarged sectional perspective view of the top of the upper housing of the cleaning supplies caddy of FIG. 1 showing the external structures of the twist-lock mechanism.

When the upper housing 10 is inverted, as shown in FIG. 4, it may be used as a container, or wash bucket, for water and detergent. The recess 20 assures that the upper surface 52 sits flush upon the ground or other flat surface. That is, the recess 20 prevents the handle 14 and first shaft 16 from protruding beyond the plane of the first surface 52.

A hook 38 provides a convenient means for hanging the lower housing 12 containing the cleaning supplies 34 upon any convenient means, such as a tree limb or clothesline. The hook 38 also functions to secure the paper towel roll 32 upon a second shaft 36.

The second shaft 36 is formed upon the lower housing 12 and extends vertically approximately the length of a standard paper towel roll, i.e. approximately 8 inches.

In the preferred embodiment, a cam 40 is formed upon the uppermost end of the second shaft 36 and forms a portion of the twist-lock latch mechanism 82. Those skilled in the art will recognize that other types of latching mechanisms are likewise suitable.

Figure 6:
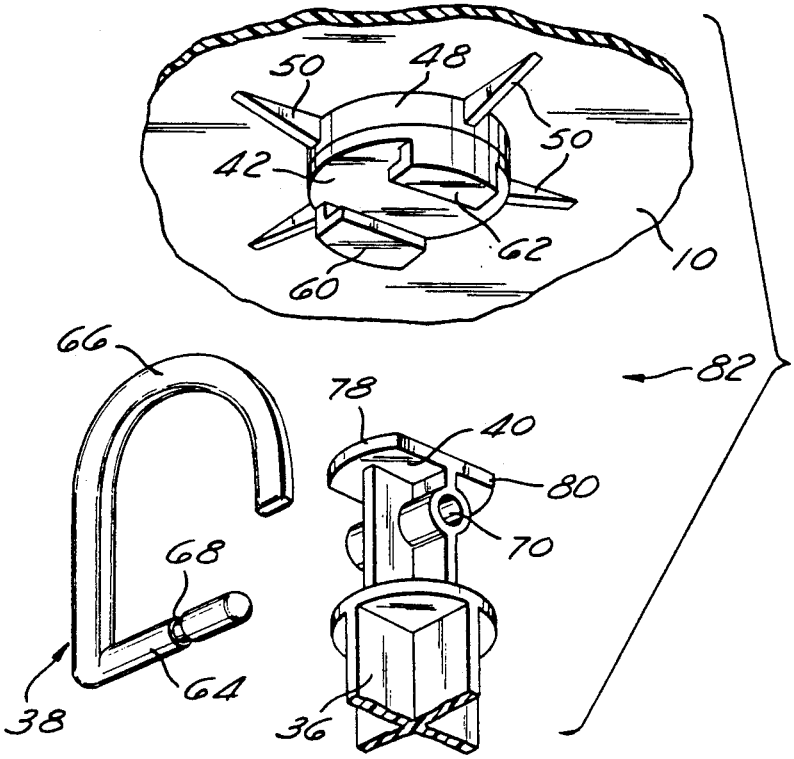
FIG. 6 is an exploded sectional perspective view of the internal structures of the twist-lock mechanism of the cleaning supply caddy of the present invention.

Referring now to FIG. 6, an enlarged view of the twist-lock latch mechanism 82 and the hook 38 is depicted. A raised boss 48 is formed upon the inner surface of the upper housing 10. A plurality of gussets 50 extend from the raised boss 48 to the inner surface of the upper housing 10. A cam receiver 42 is rotatably attached through the raised boss 48 of the upper housing 10 and connects to the first shaft 16. Thus, rotation of the handle 14 about its vertical axis causes rotation of the first shaft 16 and the cam receiver 42. First 60 and second 62 latch elements are formed upon the cam receiver 42.

Lobes 78 and 80 are formed upon the cam 40 and are engaged by the first 60 and second 62 latch elements to engage the twist-lock mechanism 82.

The hook 38 is comprised of a straight elongate portion 64 and a curved portion 66. The straight elongate portion 64 has a groove 68 formed therein and is sized to be received by a hook aperture 70 formed intermediate the cam 40 and the second shaft 36. The straight elongate portion 64 of the hook 38 is restrained within the hook aperture 70 by detents (not shown) formed within the hook aperture 70 which engage the groove 68 formed within the straight elongate portion 64. The hook 38 is therefore free to pivot about the straight elongate member 64 within the hook aperture 70 but will only slide out of the hook aperture 70 under force. The hook 38 may therefore be used to secure a roll of paper towels 32 or the like upon the second shaft 36.

Figure 7:
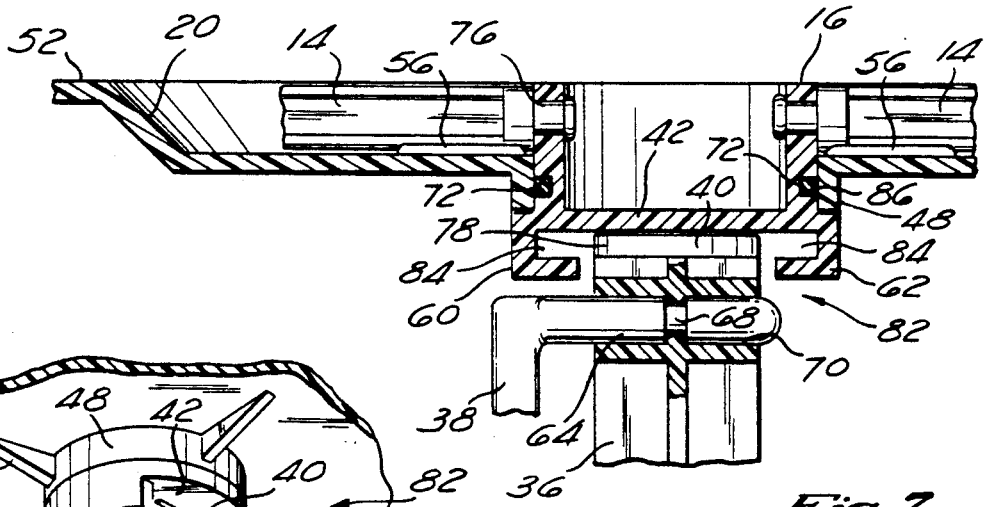
FIG. 7 is a cross sectional side view of the twist-lock mechanism of the cleaning supply caddy of the present invention.

Referring now to FIG. 7, a cross sectional side view of the twist-lock latch mechanism 82 is depicted. It can be seen that rotation of the handle 14 about its vertical axis would cause a like rotation of the first shaft 16 and the first 60 and second 62 latch elements of the cam receiver 42. Rotation of the cam receiver 42 causes the first 60 and second 62 latch elements to engage or disengage the lobes 78 and 80 of the cam 40. When the first 60 and second 62 latch elements engage the lobes 78 and 80, the upper housing 10 is secured upon the lower housing 12.

In the preferred embodiment the first 60 and second 62 latch elements of the cam receiver 42 are formed such that after engaging the lobes 78 and 80, continued rotation of the handle 14 causes the first 60 and second 62 latch elements to tighten upon the lobes 78 and 80. This tightening occurs because the gap 84 formed by the first 60 and second 62 latch elements decreases in size and clamps upon the lobes 78 and 80 as the cam receiver 42 is rotated. This clamping action serves to further secure the upper housing 10 upon the lower housing 12 and to prevent inadvertent detachment thereof.

Figure 8:
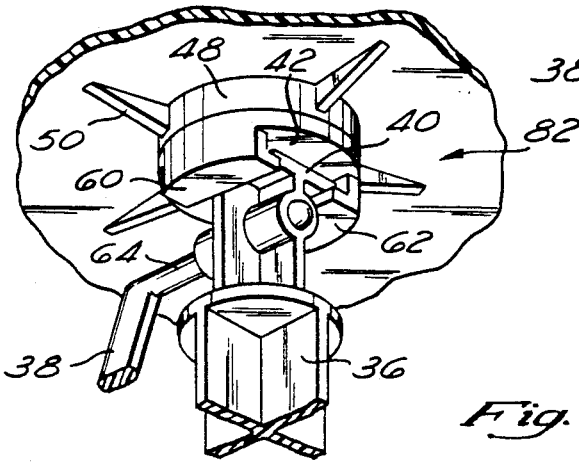
FIG. 8 is a perspective view of the internal structure of the twist-lock mechanism of FIG. 7.

A perspective view of the twist-lock latch mechanism 82 of the present invention is depicted in FIG. 8, which illustrates the cam 40 and cam receiver 42 in the engaged position. This is the position of the cam 40 and cam receiver 42 which results when the upper housing 10 is installed upon the lower housing 12 and the handle 14 is rotated to the CLOSED position. It can be seen that further rotation of the cam receiver 42 would result in disengagement of the first 60 and second 62 latch elements from the lobes 78 and 80.

The twist-lock latch mechanism 82, disposed within the upper 10 and lower 12 housings when the upper housing is attached to the lower housing 12, thus attaches the upper housing 10 to the lower housing 12 by operation from the outside of the cleaning supplies caddy by the transmission of mechanical motion through the upper housing 10.

An O-ring seal 72 disposed within a groove 86 formed in the first shaft 16 provides a watertight seal between the first shaft 16 and the upper housing 10. This permits the upper housing 10 to be inverted and used as a water container or wash bucket.

The cleaning supplies caddy of the present invention is used by detaching the upper housing 10 from the lower housing 12 and disposing cleaning supplies within the lower housing 12 and also disposing a roll of paper towels 32 or the like upon the second shaft 36. The hook 38 must be removed from the second shaft 36 to install the paper towels 32 upon the shaft 36. The hook 38 is removed from the hook aperture 70 by grasping the hook and forcing it out of the hook aperture 70. The elongate member 64 of the hook 38 is forced back into the hook aperture 70 after the roll of paper towels is placed over the second shaft 36.

The upper housing 10 is placed upon the lower housing 12 such that the tab 28 is received by the channel 22, thereby insuring proper alignment of the upper 10 and lower 12 housings. The handle 14 is rotated from its position between the OPEN detents 54 to a position between the CLOSED detents 56. This causes the engagement of the twist-lock latch mechanism 82, thereby securing the upper housing 10 to the lower housing 12. The handle 14 is then rotated about its horizontal axis to be flush with the upper surface 52 of the upper housing 10 if the cleaning supplies caddy is to be stored immediately, or the handle 14 may be left upright to facilitate carrying of the cleaning supplies caddy to another location.

The cleaning supplies 34 stored within the cleaning supplies caddy of the present invention are used by simply rotating the handle 14 about its horizontal axis to an upright or operably disposed position, then rotating the handle 14 about its vertical axis from the CLOSED detents 56 to the OPEN detents 54 to disengage the twist-lock latch mechanism 82 and permit the upper housing 10 to be removed from the lower housing 12. The lower housing 12, containing the cleaning supplies and roll of paper towels 32 or the like may then be hung from any convenient means by hanger 38 such that the cleaning supplies 34 and paper towels 32 will be easily accessible. The upper housing 10 may be inverted and filled with water and detergent and used as a conventional cleaning bucket.

It is understood that the exemplary cleaning supplies caddy described herein and shown in the drawings represents only a presently preferred embodiment of the invention. Indeed, various modifications and additions may be made to such embodiment without departing from the spirit and scope of the invention. For example, the shape and size of the upper and lower housings may be varied considerably while still maintaining the ability to conveniently store and transport cleaning supplies. Furthermore, various latching mechanisms may be utilized to secure the upper and lower housings together. Furthermore, various types of seals other than O-rings are suitable for providing a watertight seal between the first shaft 16 and the upper housing 10. Thus, these and other modifications and additions may be obvious to those skilled in the art and may be implemented to adapt the present invention for use in a variety of different applications.

What is claimed is:

1. A cleaning supplies caddy comprising:

(a) a lower housing having a first wall substantially about its perimeter for receiving and containing cleaning supplies, the first wall for maintaining the cleaning supplies within said lower housing;

(b) an upper housing removably attachable to said lower housing and capable of being used as a container for liquids when removed from said lower housing and inverted;

(c) a rotatable first shaft for transmitting rotational motion through said upper housing, said first shaft passing through said upper housing;

(d) a handle attached to the upper end of said first shaft for rotating said first shaft, said handle also suitable for carrying the container (e) a latch mechanism sized, configured, and positioned within said cleaning supplies caddy, said latch mechanism actuatable by the rotation of said shaft, for removably attaching said upper housing to said lower housing.

(f) a seal disposed intermediate said shaft and said upper housing, said seal permitting rotation of said shaft and capable of preventing the flow of water between said shaft and said upper housing; and (g) a second shaft formed upon said lower housing, said second shaft suitable for receiving and dispensing paper towels.

2. The container as recited in claim 1 wherein:

(a) said latch mechanism further comprises a cam and cam receiver;

(b) said seal comprises an O-ring;

(c) said lower housing further comprising a second wall formed intermediate said first wall and said second shaft for substantially isolating the cleaning supplies from paper towels disposed upon said second shaft.

3. The cleaning supplies caddy as recited in claim 2 further comprising:

(a) a hook disposable upon one end of said second shaft for securing the paper towels upon said second shaft and for hanging said lower housing for convenient use;

(b) at least one detent formed upon said upper housing for temporarily securing said latch mechanism in an engaged position to prevent inadvertent separation of said upper housing from said lower housing.

4. The cleaning supplies caddy as recited in claim 3 further comprising:

(a) a channel formed between said first wall and said second wall through which paper towels may be dispensed; and (b) a tab formed upon said upper housing, said tab being receivable by said channel to insure proper alignment of said upper housing with said lower housing.

5. The cleaning supplies caddy as recited in claim 4 further comprising a recess formed in the upper surface of said upper housing, said handle being disposable completely within said recess to permit the upper surface of said upper housing to sit flush upon a flat surface when said upper housing is inverted.

6. A cleaning supplies caddy comprising:

(a) a lower housing;

(b) an upper housing removably attachable to said lower housing;

(c) a cam and a cam receiver, said cam and said cam receiver being sized, configured, and positioned within said cleaning supplies caddy to attach said upper housing to said lower housing, said cam and said cam receiver being operable from outside of the cleaning supplies caddy by the transmission of mechanical motion through said upper housing;

(d) a handle disposed upon said upper housing for actuation of said cam and said cam receiver, said handle being suitable for carrying said container;

(e) a means attached to said handle for transmitting mechanical motion from said handle through said upper housing to said cam and said cam receiver, said means for transmitting mechanical motion through said upper housing comprising a rotatable shaft which passes through said upper housing to transmit rotational mechanical motion through said upper housing to engage and disengage said cam and said cam receiver, said means for transmitting mechanical motion further comprising an O-ring disposed intermediate said shaft and said upper housing, said O-ring permitting rotation of said shaft and capable of preventing the flow of water between said shaft and said upper housing; and (f) means for dispensing paper towels, said dispensing means disposed upon said lower housing and comprising a second shaft formed upon said lower housing, paper towels being disposable upon said second shaft.

7. A cleaning supplies caddy comprising:

(a) a lower housing suitable for containing cleaning supplies;

(b) an upper housing removably attachable to said lower housing, said upper housing suitable for use as a wash bucket;

(c) a means for dispensing paper towels, said means formed upon said lower housing and disposed within said cleaning supplies caddy, said means for dispensing paper towels comprising a shaft formed upon said lower housing, paper towels being disposable upon said shaft;

(d) a cam and a cam receiver sized, configured, and positioned within said cleaning supplies caddy to attach said upper housing to said lower housing, said cam and said cam receiver being operable from outside of the cleaning supplies caddy by the transmission of mechanical motion through said upper housing;

(e) a handle disposed upon said upper housing for actuation of said cam and said cam receiver, said handle being suitable for carrying said container; and (f) a means attached to said handle for transmitting mechanical motion through said upper housing to said latch mechanism, said means for transmitting mechanical motion through said upper housing comprising a rotatable shaft which passes through said upper housing to transmit rotational mechanical motion through said upper housing to engage and disengage said cam and said cam receiver.

8. The cleaning supplies caddy as recited in claim 7 wherein said means for transmitting mechanical motion through said upper housing further comprises a seal disposed intermediate said shaft and said upper housing, said seal permitting rotation of said shaft and capable of preventing the flow of water between said shaft and said upper housing.

9. The cleaning supplies caddy as recited in claim 8 wherein said seal comprises an O-ring.

* * * * *